United States Patent [19]

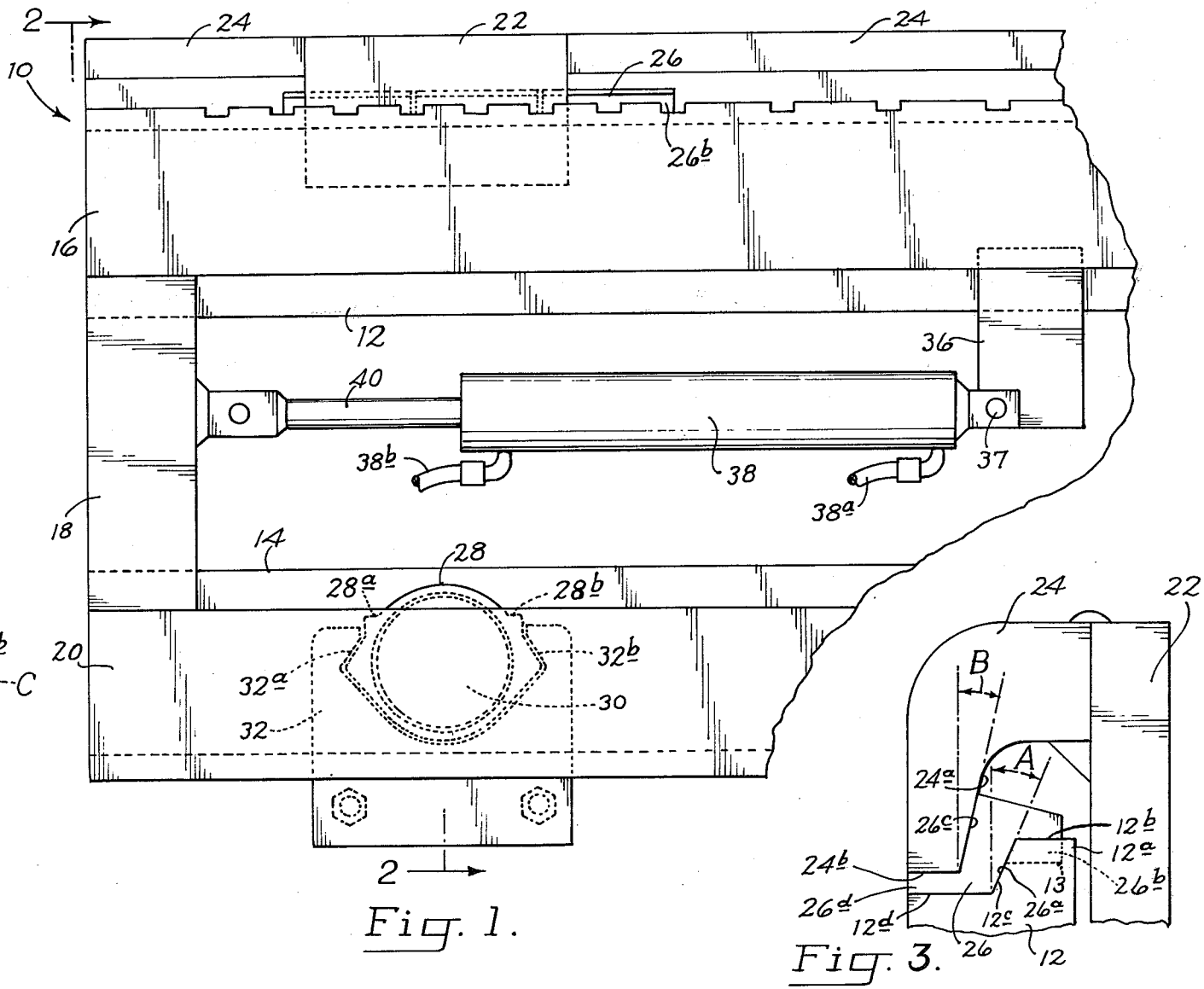
Fig. 1.
Fig. 3.
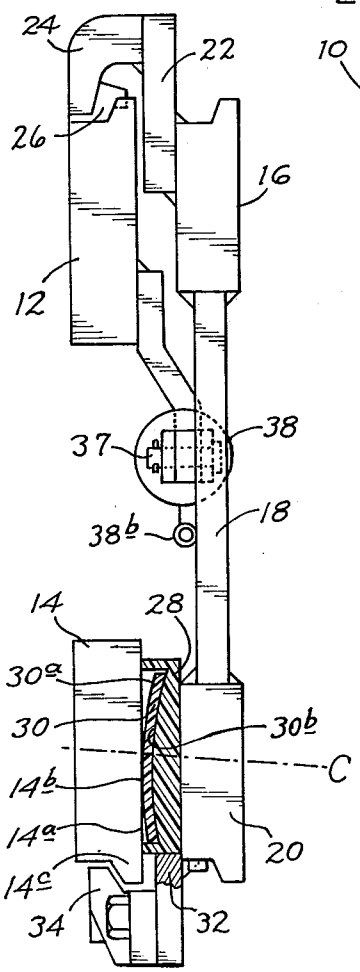
Fig. 2.

Faust et al.

[11] 4,165,008

[45] Aug. 21, 1979

[54] SLIDER ROLLER SIDE SHIFTER FOR USE ON A FORKLIFT TRUCK

[75] Inventors: Donald M. Faust, Gresham; Harry F. Weinert, Portland, both of Oreg.

[73] Assignee: Cascade Corporation, Portland, Oreg.

[21] Appl. No.: 820,454

[22] Filed: Aug. 1, 1977

Related U.S. Application Data

[63] Continuation-in-part of Ser. No. 638,079, Dec. 5, 1975.

[51] Int. Cl.[2] ..... B66F 9/06

[52] U.S. Cl. ..... 414/750; 414/730

[58] Field of Search ..... 214/730–731, 214/750, 768, 138 C, 650–653; 308/2 R, 3 R, 3.6, 3 A, 62, 72–73, 235, 163, 35; 280/32.6; 143/35 R, 35 MP, 37

[56] References Cited

U.S. PATENT DOCUMENTS

| | | | |
|---|---|---|---|
| 2,861,279 | 11/1958 | Myers | 280/32.6 X |
| 3,445,143 | 5/1969 | Swenson | 308/3.6 |
| 3,460,700 | 8/1969 | Kroupa | 214/730 |
| 3,512,671 | 5/1970 | Morocco | 214/730 |
| 3,528,579 | 9/1970 | Ulinski | 214/730 |
| 3,763,980 | 10/1973 | Von Stein et al. | 193/35 R |
| 3,874,491 | 4/1975 | Faure | 193/35 MD |
| 3,974,927 | 8/1976 | Schuster | 214/730 |

FOREIGN PATENT DOCUMENTS

| | | | |
|---|---|---|---|
| 215903 | 6/1961 | Austria | 193/35 MD |
| 665199 | 6/1965 | Belgium | 193/35 R |
| 1481437 | 5/1969 | Fed. Rep. of Germany | 193/35 R |
| 167454 | 5/1934 | Switzerland | 280/32.6 |

*Primary Examiner*—Francis S. Husar
*Assistant Examiner*—R. B. Johnson
*Attorney, Agent, or Firm*—Chernoff & Vilhauer

[57] ABSTRACT

A side shifter mountable on a conventional hook-type lift truck carriage. The shifter includes an upper hook which, through removable wear shoes, accommodates a sliding engagement between the shifter and the upper bar in such a carriage, and a rotary spherical-segment bearing disposed below the hook which accommodates a rolling point contact with the lower bar in such a carriage.

5 Claims, 3 Drawing Figures

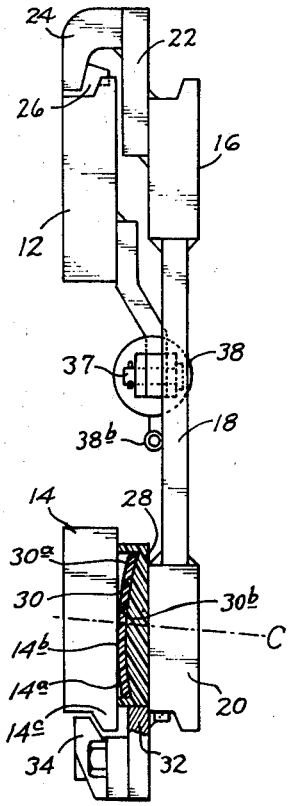

SLIDER ROLLER SIDE SHIFTER FOR USE ON A FORKLIFT TRUCK

CROSS REFERENCE TO RELATED APPLICATION

This is a continuation in-part of our prior-filed copending application Ser. No. 638,079, filed Dec. 5, 1975, for "Slider/Roller Side Shifter for Use on a Forklift Truck".

BACKGROUND AND SUMMARY OF THE INVENTION

This invention pertains to a side shifter, and more particularly to such a unit which is especially adapted for mounting on a conventional ITA hook-type lift truck carriage.

As is well known, forklift trucks are widely used in industry for the handling of various kinds of loads. Such a truck has the usual upright telescopic mast on which rides a vertically movable carriage. Various attachments, including lift forks, are made for mounting on such a carriage.

While there are a number of different lift truck constructions available, it is common to find most of these trucks equipped with the well known so-called ITA hook-type carriage. This kind of carriage has a standardized configuration, the specifications of which have been defined by an association of lift truck manufacturers known as the "Industrial Truck Association" (thus the abbreviation ITA), and includes upper and lower spaced horizontal bars joined through suitable interconnecting plates located adjacent the opposite ends of the carriage. The upper edge of the upper bar is formed with a standardized lip for accommodating, through the hook, mounting of various attachments on the carriage.

One kind of attachment which is extremely popular is a so-called side shifter. Such a unit is mounted on a carriage for bi-directional lateral movement, and is intended to carry a variety of different load-handling attachments. With a side shifter operating in place, a truck operator need not be concerned about precise lateral positioning of his truck during load-handling. Operation of the side shifter allows him to correct the lateral position of whatever load-handling attachment he is using.

A problem with known side shifters, however, is that their lateral movements over a period of time produce considerable wear which can require substantial maintenance, and costly down time. For example, in many side shifters there is a relatively high-friction contact that exists between the frame in the side shifter and a carriage carrying the same. Efforts in the past to correct this situation, as by adding rotary bearings, have only been partly successful. While such bearings do yield a lower-friction contact between a side shifter and a carriage, the bearings themselves have proven to be weak points in the construction, particularly with respect to high impact resistance. In other words, in the ordinary operation of a lift truck, there is a considerable amount of bumping and jostling, and impact as a truck is moved toward a load to pick it up. Rotary bearings used heretofore have not well withstood this kind of abuse.

Yet another approach to resolve these problems in the past has involved either the construction of a special carriage with special low-friction high-impact-resistance wear surfaces, or substantial modification of conventional carriages. These have proven to be a very costly approaches, and have not found much favor.

A general object of the present invention is to provide a unique side shifter that features a mounting arrangement which takes all of the above considerations into account in a highly practical and satisfactory manner.

More specifically, an object of the invention is to provide such a unit that can be mounted readily on a conventional widely used ITA hook-type carriage without requiring any modification of the latter.

Another object of the invention is to provide such a shifter in which relatively low-friction contact is obtainable between the frame in the shifter and the carriage.

Still a further object of the invention is to provide a shifter of the type generally outlined in which bearing surfaces between the shifter and the carriage carrying the same are capable of withstanding extremely high impact conditions.

According to a preferred embodiment of the invention, the side shifter includes an upper hook which accommodates a sliding engagement between the shifter and the upper bar in a carriage of the type described. More specifically, this hook is intended to ride on low-friction removable wear shoes that are mounted on the lip in the upper bar of such a carriage. Further featured in the side shifter of the invention are rotary bearings that ride against the front face of the lower bar in the carriage. More particularly, each of these rotary bearings takes the form generally of a segment of sphere, which segment presents a relatively large-diameter spherical bearing surface that affords substantially rolling point contact with the lower bar in the carriage. Each of these bearings is mounted for rotation about an axis which, with the side shifter in place on a carriage, slopes slightly upwardly and rearwardly relative to the horizontal. Each bearing has a large back surface area which rides on a low-friction material that provides an extremely large bearing surface for the handling of any front impact loads on the side shifter.

These and other objects and advantages which are attained by the invention will become more fully apparent as the description which now follows is read in conjunction with the accompanying drawings.

DESCRIPTION OF THE DRAWINGS

FIG. 1 is a fragmentary front elevation showing a side shifter constructed in accordance with the present invention mounted on a conventional ITA hook-type lift truck carriage.

FIG. 2 is a side elevation, with portions shown in cross section, taken generally along the line 2—2 in FIG. 1.

FIG. 3 is an enlarged fragmentary view showing details of a hook and wear shoe engagement illustrating mounting of the upper portion of the side shifter on the carriage in FIG. 1.

DETAILED DESCRIPTION OF THE INVENTION

Turning now to the drawings, indicated generally at 10 in FIG. 1 is a side shifter constructed in accordance with the present invention. Side shifter 10 is illustrated in the figures mounted for operation on a conventional ITA hook-type carriage whose construction is standardized in the industry, and is well known. This carriage is mounted in the usual manner for vertical travel on the telescopic mast in a lift truck—neither of the latter two units being shown in the drawings. The carriage herein which supports side shifter 10 includes the usual upper and lower horizontal bars 12, 14 which are joined together through interconnecting upright end bars (not shown in drawings). Upper carriage bar 12 is formed with the usual upwardly projecting lip 12*a* which has an upper horizontal surface 12*b*, and an inclined rear face 12*c*. Face 12*c* joins with a horizontal rear ledge 12*d*. This construction along this top of bar 12 is referred to herein as a slide-accommodating means.

The upper carriage bar is also provided with the usual plurality of notches 13 which extend through lip 12*a* and which are distributed along the length of the lip. As is well understood, lip 12*a* accommodates hooking onto the carriage of various load-handling attachments. Notches 13 are provided to receive one or more projections formed in a hook on an attachment to lock the same against lateral shifting on the carriage. In the drawings herein, lip 12*a* and notches 13 receive a plurality of low-friction wear shoes which, as will be explained, accommodate slidable engagement between the carriage and a hook in side shifter 10.

Conventional features of lower carriage bar 14 which interact with side shifter 10 will be discussed later.

Side shifter 10 is constructed with an upper transversely extended plate 16 which is joined, as by welding, through end pieces, such as end piece 18, to a lower transversely extending plate 20. These parts make up what might be referred to as the frame in the side shifter—such frame having many of the same features found in the lift truck carriage. For example, upper plate 16, along its upper edge, includes an upwardly projecting notched lip which is like that found in upper carriage bar 12. With the side shifter in place as shown, this plate acts as a surrogate for carriage bar 12 in accommodating the attaching of various load-handling attachments. Similarly, lower plate 20 in the side shifter frame has features substantially duplicative of the features in lower carriage bar 14.

Joined as by welding to the back face of plate 16 are two laterally spaced upwardly projecting connecting plates, such as the connecting plate shown at 22 in FIGS. 1 and 2. Joined as by welding to the back face of each plate 22 is an elongated hook 24 having the cross-sectional configuration illustrated therefor in FIGS. 2 and 3. Hook 24 is also referred to herein both as a hook means, and as a first mounting means.

Seated on the upper edge of carriage bar 12 are plural friction-reducing wear shoes, such as those shown at 26 in the figures. These shoes are placed in groups of side-by-side adjacency on the upper carriage bar, as is illustrated for three shoes in FIG. 1.

Considering for a moment the construction of shoes 26, and referring especially to FIG. 3, each shoe has a face 26*a* which, with the shoe in place on carriage bar 12, contacts rear face 12*c* in lip 12*a*. Substantially centrally between its opposite ends, each shoe includes a downwardly projecting lug 26*b* which is received in a notch 13. As can be seen in FIG. 3, with a shoe properly in place on the upper carriage bar, face 26*a* is substantially coplanner with face 12*c*—this plane inclining at an angle A which is conventionally approximately 20° relative to the vertical. Also formed on each wear shoe herein is a rear face 26*c* which slopes generally in the same direction as face 26*a*, except at a considerably smaller angle relative to the vertical. This angle is illustrated at B in FIG. 3, and is approximately 15°. The lower portion of hook 24 herein is formed with a sloping face 24*a* which, with the hook received as shown on the wear shoes, contacts and is substantially coplanner with shoe faces 26*c*. The bottom edge 24*b* in hook 24 rides on the upper surfaces of rearwardly projecting ledges 26*d* in the shoes, which ledges directly overlie rear ledge 12*d* in carriage bar 12.

While various low-friction materials may be used for the wear shoes, a material which has been found to function especially well for this purpose comprises a nylon filled with molydisulfide.

In conventional wear shoes, bearing surfaces therein corresponding to bearing surface 26*c* slope at substantially the same angle relative to the vertical as face 12*c*. However, because of the low-friction performance which is attained in the operation of side shifter 10 herein, it has been found to be preferable to provide a hook 24 and wear shoes 26 having inclined contacting faces which slope at a steeper angle—namely, angle B shown in FIG. 3. This steeper angle tends to minimize any tendency of the side shifter to climb as it shifts laterally.

According to an important feature of the invention the lower portion of side shifter 10 is equipped with unique roller bearings which are intended to ride against the front face, or forwardly facing surface, 14*a* of lower carriage bar 14 as the side shifter is shifted. In particular, side shifter 10 is equipped with two such roller bearings, one of which is illustrated in FIGS. 1 and 2.

Considering the details of construction of the roller bearing assembly illustrated in these two figures, mounted as will shortly be explained against the back face of plate 20, at the location illustrated, is a housing 28 which freely contains, in a pocket formed therein, a rotatable case-hardened steel disc bearing 30. The outside perimetral shape of the housing is as illstrated in FIG. 1, and is seen therein to include a pair of upper projections 28*a*, 28*b*. Housing 28 is retained against the back face of plate 20 through a housing mount 32 which is suitably joined to the back face of plate 20, and which includes a socket having projecting portions 32*a*, 32*b* shaped to receive housing 28 as shown.

Referring for a moment particularly to FIG. 2, bearing 30, according to an important aspect of the invention, takes the form generally of a segment of a sphere. What is important in this respect is that a slightly convex spherical face 30*a* in the bearing takes the form of such a segment, having a radius of curvature which is relatively large. The largeness of the size of this radius is evident from the very slight convex curvature apparent in face 30*a*. Radii which have been found to be effective range between about twelve and fifteen inches. While the back side of disc 30*a* may have a number of different specific configurations, such back side herein, indicated at 30*b*, is also spherical, and this back face rides against a matching spherical support surface formed in housing 28. As can be seen in FIG. 2, face 30 *b* is fully supported across the entirety of its expanse. Various low-friction materials may be used for housing 28. Herein, the housing employs essentially the same material which makes up the wear shoes.

Yet another important feature is that disc 30 is supported for rotation about a slightly upwardly and rearwardly inclined axis relative the horizontal, such axis being illustrated at C in FIG. 2. It will be noted that axis C is also nearly normal to the plane of face 14*a*.

With the side shifter in place on the carriage as shown, the disc bearings in the lower bearing assemblies are positioned for substantially rolling point contact with front face 14*a* in bar 14. With reference to FIG. 2, the point-like region of contact between bearing 30 and face 14*a* exists at the location indicated at 14*b*.

Previously mentioned projections 28*a*, 28*b* in housing 28 are provided to ensure that the housing may be inserted in only one fashion in mount 32. This is important in assuring that the rotation axes C for the bearings are properly oriented.

Suitably mounted adjacent the base of plate 20, at the two locations near the roller bearing assemblies, are hook assemblies, such as assembly 34 shown in FIG. 2, which are adapted to hook against downwardly projecting lip 14*c* in lower carriage bar 14. These lower hook assemblies may conveniently be mounted against the back faces of housing mounts 32.

Completing now a description of what is shown in the drawings, suitably joined to one side of the front face in upper carriage bar 12, and projecting downwardly therefrom, is a bracket 36 which accommodates the pivotal mounting at 37 of the butt end of a hydraulic cylinder 38, the rod end 40 of which is suitably pivotally connected by another pivot connection 37*a* to end plate 18 in the side shifter. Hydraulic fittings 38*a*, 38*b* adjacent the opposite ends of the cylinder accommodate conventional connections with the usual hydraulic control system provided in a lift truck.

With the side shifter of the invention, an extremely efficent, low-maintence type of performance is obtainable. Especially important is the incorporation in the side shifter of the lower rotary disc bearing assemblies, which afford both substantially rolling point contact with the front face of a lower bar in a carriage of the type described, and extremely high impact resistance. The rolling point contact results from the slightly off-horizontal inclination for rotary axes C. High impact resistance results primarily from the extremely large radius which is used to define the spherical bearing surfaces in the disc bearings, as well as from the fact that the entire back surface expanses of the bearings are supported by complementary surfaces in housings 28.

Cooperating with the rotary bearings are hook 24 and wear shoes 26. These provide for a low-friction slidable mounting for the upper end of the side shifter. The differently angled faces 26*a*, 26*c* in the wear shoes function as generally described above. More particularly, face 26*a* is inclined to allow fitment of the wear shoes on the upper edge of the conventional upper carriage bar in an ITA hook-type carriage. More steeply inclined surface 26*c* minimizes, along with matching surface 24*a* in the hook, any tendency of the side shifter to climb as it shifts laterally.

Efficiency of operation is attained through reduction of friction in the movable contact between the side shifter and a carriage. Maintenance is held to a minimum through affording bearing surfaces which can easily withstand extremely high impact loads without any appreciable damage.

Another important matter to note is that the side shifter of the invention is adapted to mount on a conventional ITA hook-type carriage, without requiring any modification of the latter. Thus, the problems and costs attendant with specially prepared carriages, as well as with modified carriages, are avoided.

While a preferred embodiment of the invention has been described herein, it is appreciated that variations and modifications may be made without departing from the spirit of the invention.

It is claimed and desired to secure by letters patent:

1. A side shifter adapted for mounting upon the front of a vertically movable lift truck carriage, of the type having a transverse mounting member adjacent the top of the carriage and a transverse forwardly-facing surface below said transverse mounting member, for mounting a load-handling attachment upon the carriage with the side shifter interposed structurally between the carriage and attachment so that the attachment is transversely movable with respect to the carriage, said side shifter comprising:

(a) forwardly-facing front mounting means for mounting the load-handling attachment thereon;

(b) first rearwardly-facing mounting means connected to said front mounting means for movably engaging the transverse mounting member of said carriage so as to vertically support said front mounting means and permit said front mounting means to move transversely with respect to said carriage;

(c) second rearwardly-facing mounting means connected to said front mounting means, at a location below said first rearwardly-facing mounting means, for movably engaging the forwardly-facing surface of said carriage, said second rearwardly-facing mounting means comprising a substantially disc-shaped bearing having means defining a rearwardly-facing, generally spherical convex bearing surface on one side thereof for rollingly contacting the forwardly-facing surface of said carriage and having means defining a forwardly-facing surface on the side thereof opposite said convex bearing surface; and (d) bearing mounting means on said front mounting means, for rotatably mounting said disc-shaped bearing upon said front mounting means, comprising rearwardly-facing surface means for rotatably engaging said forwardly-facing surface of said disc-shaped bearing over an area substantially coextensive with said convex surface of said bearing so as to transmit forces from said front mounting means through said area toward the forwardly-facing surface of said carriage said bearing mounting means including means for requiring said bearing to rotate about an axis of rotation which is inclined upwardly in a direction from front to rear.

2. The side shifter of claim 1 including means for detachably operatively mounting said bearing mounting means upon said front mounting means in an orientation requiring said bearing to rotate about said inclined axis, and for preventing the mounting of said bearing mounting means in any other operative orientation.

3. A side shifter adapted for mounting upon the front of a vertically movable lift truck carriage, of the type having a transverse mounting member adjacent the top of the carriage and a transverse forwardly-facing surface below said transverse mounting member, for mounting a load-handling attachment upon the carriage with the side shifter interposed structurally between the carriage and attachment so that the attachment is transversely movable with respect to the carriage, said side shifter comprising:

(a) forwardly-facing front mounting means for mounting the load-handling attachment thereon;

(b) first rearwardly-facing mounting means connected to said front mounting means for movably engaging the transverse mounting member of said carriage so as to vertically support said front mounting means and permit said front mounting means to move transversely with respect to said carriage;

(c) second rearwardly-facing mounting means connected to said front mounting means, at a location below said first rearwardly-facing mounting means, for movably engaging the forwardly-facing surface of said carriage, said second rearwardly-facing mounting means comprising a substantially disc-shaped bearing having means defining a rearwardly-facing, generally spherical convex bearing surface on one side thereof for rollingly contacting the forwardly-facing surface of said carriage and having means defining a forwardly-facing surface on the side thereof opposite said convex bearing surface; and (d) bearing mounting means on said front mounting means, for rotatably mounting said disc-shaped bearing upon said front mounting means, comprising rearwardly-facing surface means for rotatably engaging said forwardly-facing surface of said bearing and requiring said bearing to rotate about an axis of rotation which is inclined upwardly in a direction from front to rear.

4. The side shifter of claim 3 wherein said rearwardly-facing surface of said bearing mounting means is inclined forwardly so as to require said bearing to rotate about said inclined axis.

5. The side shifter of claim 4 wherein said front mounting means includes means defining a socket on said front mounting means for detachably accepting the insertion of said bearing mounting means therein, said socket and bearing mounting means having complementary-shaped means for permitting the insertion of said bearing mounting means into said socket only in a single operative orientation such that said rearwardly-facing surface of said bearing mounting means is in said forwardly-inclined position.

* * * * *